United States Patent [19]

Jeppesen

[11] 4,386,481

[45] Jun. 7, 1983

[54] TILTING WINDOW

[75] Inventor: Stig E. Jeppesen, Roskilde, Denmark

[73] Assignee: V. Kann Rasmussen Holding A/S, Søborg, Denmark

[21] Appl. No.: 326,064

[22] Filed: Nov. 30, 1981

[30] Foreign Application Priority Data

Dec. 10, 1980 [DK] Denmark ..... 5270/80

[51] Int. Cl.[3] ..... E05D 15/28

[52] U.S. Cl. ..... 49/248; 16/370

[58] Field of Search ..... 49/248, 246, 261, 249, 49/205, 345; 16/370

[56] References Cited

U.S. PATENT DOCUMENTS 3,721,044 3/1973 Kvasnes ..... 49/248

3,758,990 9/1973 Balanos ..... 49/248 X

FOREIGN PATENT DOCUMENTS 122614 10/1971 Norway .

*Primary Examiner*—Philip C. Kannan

*Attorney, Agent, or Firm*—Lane, Aitken & Kananen

[57] ABSTRACT

In a tilting window having a sash journalled on a horizontal axis at the lowermost end of a suspension arm which through two further arms or links of different lengths are movably connected to the main frame of the window, the sash is moreover connected with one of said further arms through an additional link coordinating the tilting movement of the sash with the angular movement of said one arm.

The suspension arm may at the same time serve as a cover band for the upper portions of the side members of the sash and the main frame.

3 Claims, 1 Drawing Figure

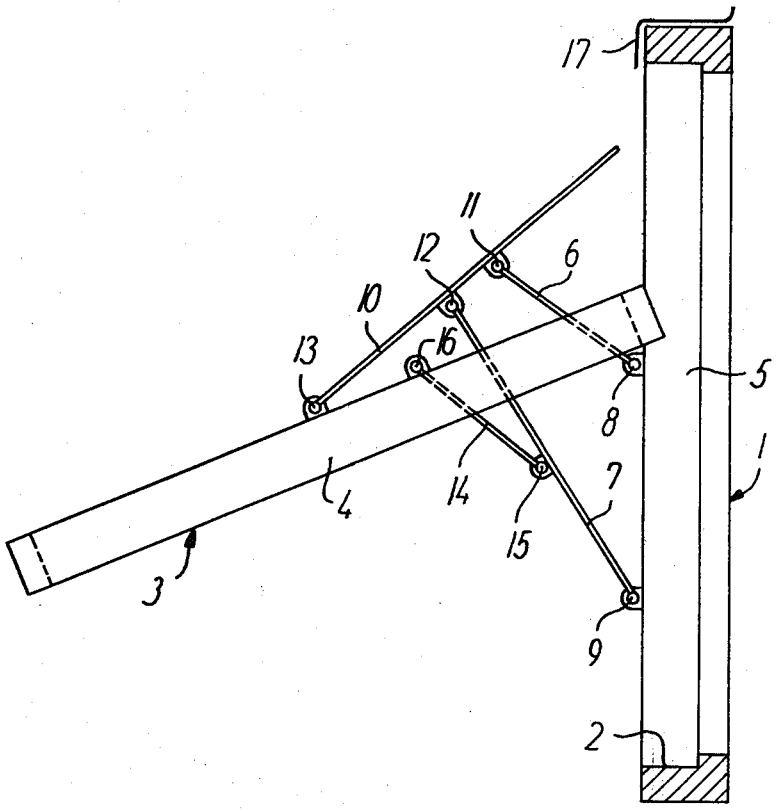
17
11
12
6
10
13
16
5
8
1
4
14
7
15
3
9
2

TILTING WINDOW

FIELD AND BACKGROUND OF THE INVENTION

This invention relates to a tilting window comprising a sash mounted in a main frame by means of hinge devices inserted between the associated side members of the sash and the main frame, respectively.

In a known window of this type, disclosed e.g. in the specification of Norwegian Patent No. 122,614, the hinge devices each includes two arms of different lengths and extending parallel to each other in the closing position of the window, both arms of each hinge device at one end being pivotally connected to the main frame at a distance greater than the longitudinal difference of the arms, and at their other ends being pivotally connected with a third arm at points having a distance which is approximately equal to the distance of the connection points on the main frame reduced by the longitudinal difference of the two first mentioned arms. The window sash is mounted in the third arm by a pivot pin located adjacent the horizontal axis through the centre of gravity of the sash, and for the purpose of coordinating the movement of the sash during opening and closing of the window with the movement of the arms, the sash is provided at either side of the window with a pin extending parallel to the tilting axis of the sash and mounted at the upper end of its side member. Each pin is slidingly received in a guide groove provided in the side member of the main frame and extending approximately over the full length thereof. A suitable dimensioning of said arms ensures that the horizontal axis through the centre of gravity of the sash during opening and closing is displaced outwardly from and inwardly against the main frame while following a substantially horizontal path so as to avoid noticeable lifting and lowering movements of the sash, and the pin and groove connection between the sash and the main frame is simultaneously responsible for the tilting movement of the sash, as it causes any displacement of said axis to be accompanied by a corresponding angular or tilting motion of the sash.

In the manufacture of windows of this type it is easy to mill out the guide grooves in the side members of the main frame as a step in their processing prior to their being assembled to a complete frame, but it might be rather difficult to perform such a milling operation in a frame after it has been mounted in situ. There has not so far been any serious need in this respect, but such a demand arises increasingly along with renewal of windows with a view to reducing the loss of heat from a building. For instance, it may be actual to substitute a single layer of glass with two or even three layers; if so, it is evident that in most cases a considerable amount could be spared if, instead of renewing the whole window, it could do only to mount a new glass-supporting frame in an existing main frame which originally may have been intended for other types of sashes.

This is made possible in a simple manner through the present invention, the principles of which, however, are obviously applicable also for production of complete windows.

SUMMARY OF THE INVENTION

The tilting window according to the invention is of the type described in the foregoing but differs from the prior design of the same type in that instead of the pin and groove connection a fourth arm is provided which is inserted between the sash and the longest one of the two arms pivotally connected to the main frame.

In this case no special demands are made on the main frame except that its dimensions correspond to the sash and that it makes it possible to establish the connection with the two first arms referred to. This latter condition is considered to be complied with by almost any windows, so that a new window sash properly dimensioned may very easily be mounted in or on an existing main frame, even without removing it from its place in the building. The new sash can be delivered with complete hinge devices assembled therewith so that the mounting work is reduced to establishing the connection with the main frame, and this may normally be carried out without special technical skille.

BRIEF DESCRIPTION OF THE DRAWING

The drawing illustrates an embodiment of the tilting window according to the invention in a rough, vertical sectional view of the window with its sash tilted about 65° outwards from its closing position.

DETAILED DESCRIPTION

The window comprises an ordinary main frame 1 with a rabbet 2 to accommodate the sash 3 of the window when closed. The sash may be of ordinary type too and is supported to have one or more layers of glass, appropriately a so-called insulating pane. Each side member 4 of said sash is connected with the associate side member 5 of the main frame through a hinge device comprising three links or arms, namely two arms 6 and 7 journalled in the side member of the main frame, the first one of which is somewhat shorter than the other one and has its pivot joint 8 positioned at a distance above the pivot joint 9 of the other arm, and a third arm 10 which at point 11 and 12 is pivotally connected with the other ends of the arms 6 and 7. Adjacent to the horizontal axis through its centre of gravity the sash side member 4 is provided with a pivot pin 13 journalled in the lower end of the third arm 10.

In the closing position the three arms 6, 7, and 10 are substantially in parallel to the outer surface of the main frame 1 which implies that the total of the length of the arm 7 and the distance between the pivot points 11 and 12 on the third arm 10 must be equal to the total of the length of the arm 6 and the distance between the pivot joints 8 and 9 on the side member 5 of the main frame. This involves that the distance between the pivot points 11 and 12 is approximately equal to the distance between the pivot joints 8 and 9 reduced by the longitudinal difference between the two arms 6 and 7.

The above mentioned hinge members 6–13 allow the sash 3 to freely pivot or tilt on the two pivot pins 13 when not impeded by the main frame 1, but in practice it is a requirement that the tilting movement of the sash is positively associated or co-ordinated with the displacement of pivot 13 away from and towards the main frame 1. This is ensured in the illustrated design by means of a fourth link or arm 14 connecting a pivot point 15 on the arm 7 with a pivot point 16 on the side member 4 of the sash. Said fourth arm 14 actually forms an additional, movable connection between the main frame and the sash and controls the tilting movement of the sash in dependence of the angular movement of the arm 7.

In the illustrated embodiment the fourth arm 14 is about half as long as the arm 7 and its pivot point 15 is located adjacent the mid-point of said arm. This provides for appropriately co-ordinating the movements and causes suitably slight forces in the members involved.

Moreover, it applies to the embodiment illustrated on the drawing that the third arm 10 extends beyond the pivot point so that its total length is a little greater than the distance from the pivot pin 13 to the upper edge of the sash 3. Thus, said arm 10 can serve as an outer flashing which in the closing position extends upwards below a casing 17 mounted on the main frame and protects the upper parts of the side members 4, 5 of the sash and of the main frame, respectively, and in particular covers the joint therebetween to improve tightness. In this case the arm 10 may further contribute to tightening the upper end of the sash 3 in its closing position, but according to requirements other measures or arrangements known per se can be used for that purpose.

I claim:

1. A window comprising a main frame including a side member, a sash including a corresponding side member extending parallel to the main frame side member in the closed position of the sash, and a hinge device connecting said sash side member with said main frame side member and including first and second arms of different lengths and pivotally connected at one end to said main frame side member at points having a greater distance from one another than the difference of length of said arms, the pivot point of the shorter one of the arms being at a level above that of the pivot point of the longer arm, a third arm which in the closed position of the sash is substantially parallel to said side member and said first and second arms and extends from the top of the window to the region adajcent the horizontal axis through the centre of gravity of said sash, said third arm being pivotally connected to the other ends of said first and second arms at points having a distance from one another which is approximately equal to the distance between said pivot points of the first ends of said first and second arms reduced by the difference of their lengths, and said third arm at its lower end being pivotally connected to said sash side member, and a fourth arm connecting the longer one of said first and second arms with said sash side member, said fourth arm at one end being pivotally connected to said longer arm substantially midway between the ends thereof, and at its other end being pivotally connected to said sash side member at a point spaced upwardly from its pivotal connection with said third arm.

2. A window as claimed in claim 1, wherein said fourth arm is approximately half as long as said longer arm.

3. A window as claimed in claim 1, wherein said third arm is an external covering for the upper portions of said side members.

* * * * *